United States Patent [19]

Aagaard

[11] Patent Number: 4,637,757

[45] Date of Patent: Jan. 20, 1987

[54] BARBED ANCHOR PILE

[75] Inventor: Paul M. Aagaard, Fullerton, Calif.

[73] Assignee: Chevron Research Company, San Francisco, Calif.

[21] Appl. No.: 660,159

[22] Filed: Oct. 12, 1984

[51] Int. Cl.[4] ..... E02D 5/54; E02D 5/74; E02D 7/02

[52] U.S. Cl. ..... 405/227; 405/228; 405/244

[58] Field of Search ..... 405/231, 232, 224, 227, 405/228, 244, 253, 259; 52/155, 160–162; 114/293–295

[56] References Cited

U.S. PATENT DOCUMENTS

| | | | |
|---|---|---|---|
| 1,081,654 | 12/1913 | Beck . | |
| 1,359,956 | 11/1920 | Boardman | 405/228 |
| 1,762,341 | 6/1980 | McPherson | 405/244 X |
| 1,982,687 | 12/1934 | O'Brien | 405/244 X |
| 1,982,963 | 9/1933 | Post | 189/92 |
| 2,696,137 | 12/1954 | Thomas et al. | 405/259 X |
| 2,987,892 | 6/1961 | Reeve | 405/227 X |
| 3,012,644 | 12/1961 | Bush | 189/92 |
| 3,115,226 | 12/1963 | Thompson, Jr. | 189/92 |
| 3,222,842 | 12/1965 | Luedloff et al. | 52/742 |
| 3,417,525 | 12/1968 | Dashio | 52/160 |
| 3,628,337 | 12/1971 | Adams | 405/244 X |
| 3,763,655 | 10/1973 | Galuska | 405/244 |
| 3,824,748 | 7/1974 | Pichowicz | 52/103 |
| 3,857,247 | 12/1974 | Phares | 405/227 |
| 3,934,528 | 1/1976 | Horton et al. | 114/0.5 D |
| 3,987,636 | 10/1976 | Hruska et al. | 405/227 X |
| 4,037,373 | 7/1977 | Echtler | 52/160 X |
| 4,351,136 | 9/1982 | Fuller | 52/155 |

FOREIGN PATENT DOCUMENTS

| | | | |
|---|---|---|---|
| 97525 | 1/1984 | European Pat. Off. | 405/244 |
| 155820 | 12/1980 | Japan | 405/244 |

*Primary Examiner*—Cornelius J. Husar
*Assistant Examiner*—Nancy J. Stodola
*Attorney, Agent, or Firm*—S. R. LaPaglia; Edward J. Keeling; P. L. McGarrigle

[57] ABSTRACT

A method and apparatus for a barbed anchor pile is described in which a pile, having horizontally placed barbs, is driven into the seafloor. Once it is buried to a predetermined depth, the barbs are spread outward into the surrounding soil to ensure that the pile will not be pulled out by uplift loads.

4 Claims, 8 Drawing Figures

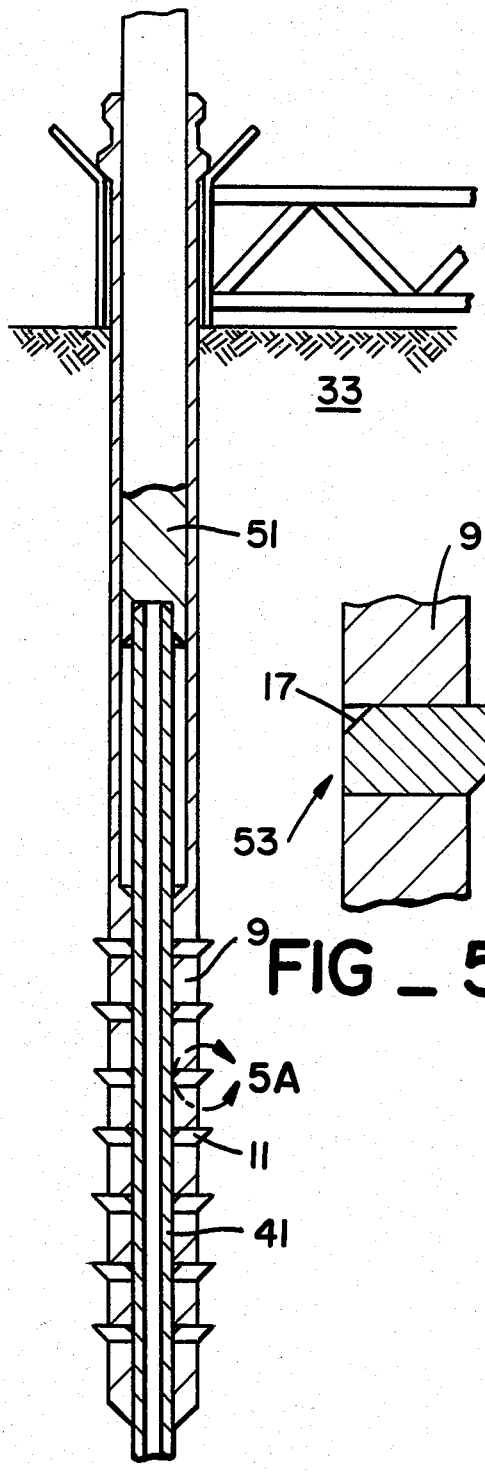
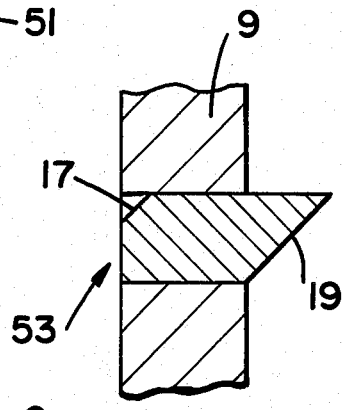
FIG _ 5A
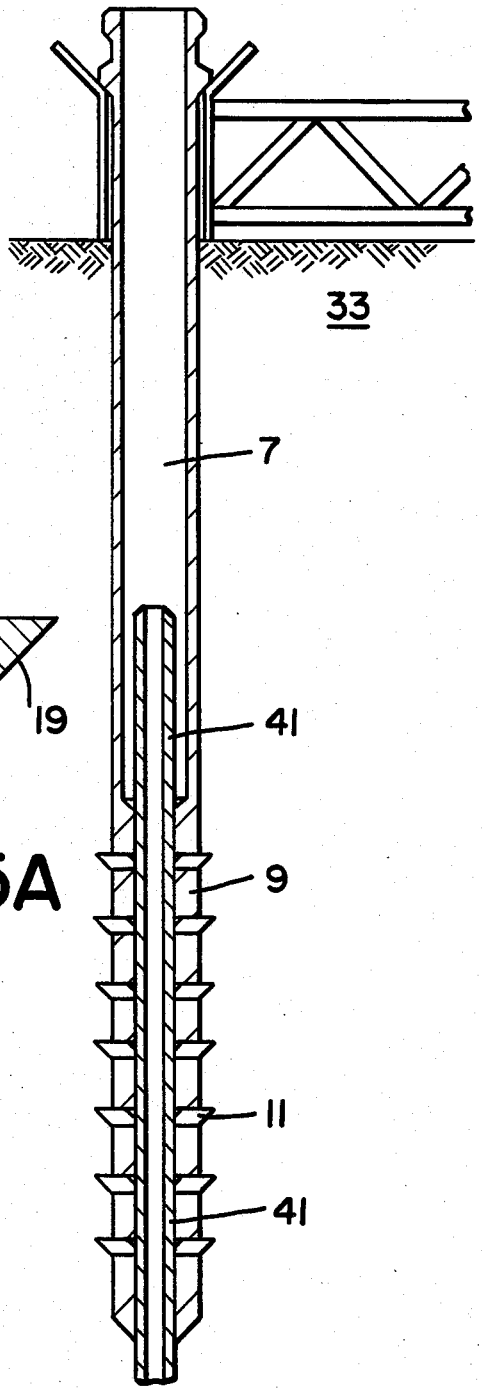
FIG _ 5
FIG _ 6

BARBED ANCHOR PILE

FIELD OF THE INVENTION

This invention relates to anchoring devices designed to be inserted into a seabed to resist uplift loads. More specifically, to anchoring offshore drilling structures that have a positive buoyancy such as a tension leg platform (TLP).

BACKGROUND OF THE INVENTION

Many types of devices may be used to anchor an offshore structure to the seafloor. Cement bases or blocks, clump weights, and standard cylindrical piles are just a few examples of how to accomplish siting in some types of offshore structures. However, these anchoring methods and devices may not be adequate or exacting enough for platforms with a higher positive buoyancy such as a Tension Leg Platform (TLP). One common technique that is used to anchor a TLP connects the leg tendon directly to a hollow cylindrical anchor piling. The bottom of the pile is cut at a 45° angle then stabbed into a template on the seafloor and driven with a hammering device until it may no longer continue. This termination is based on the structure in the underlying seafloor and is called the depth of refusal. Since the friction on the pile is what resists uplift loads, driving to a refusal depth is done to obtain as much capacity as possible for a given piling. Safety improvements and cost reductions can be accomplished if the tendons connect directly to the piling. To do this, it is essential that the piling be driven exactly to a predetermined grade in order that the tendons that connect the buoyant structure to the seafloor be of equal length and tension. With variations in the soil properties between piling locations it is unlikely that all the piling may be driven to a preset depth thus presenting the problems mentioned above. Furthermore, when a pile cannot be driven any further it must be cut off so that all the tendon lengths will be equal. This is also undesirable because of the necessity of having machined surfaces that are compatible with tendon coupling.

An existing alternative method involves the use of drilled and grouted piling. Here, a template is used to drill an oversized hole, i.e., one larger than the piling. Once the hole is completed, the pile is lowered into the hole and cemented. This may be done in any number of ways. For example, cement may be forced in the annular space between the pile and the soil from the bottom up or it may be squeezed through holes in the pile, again in stages from the bottom up. The force that is used to resist uplift loads is friction between surfaces, i.e., the soil/cement interface and the cement/steel pile interface. The disadvantages of this method are the uncertainties in installation techniques and the resulting piling capacity. For example, placement of the grout may be difficult, the hole for the piling may not be straight, the mud around the piling itself may tend to cake and interfere with the entire process, the grout may flow into an adjacent hole, or the hole itself may deteriorate or collapse.

Other anchoring methods form a hole at the base of the anchor pile and cement an enlarged portion of the pile into place. However, these steps are not necessarily easy to accomplish in the subsea environment and may be more complex than necessary to fill the job need.

Consequently, it is an object of this invention to develop an anchor that resists uplift loads and may be driven to an exact preset depth which may be less than the depth of refusal. It is another object of this invention to develop a pile which may be driven into soil of varying resistance and also be able to provide equal tension capacity for all of the tension leg platform tendons.

SUMMARY OF THE INVENTION

A method and apparatus is described for anchoring a tension leg platform that will resist uplift loads. The invention is a hollow pile that decreases in internal diameter partially down the length of the pile. It contains 50 to 100 barbs placed at approximately 90° to the axis of the pile, and accommodates a spreader tool that may be inserted into the pile to force the barbs outwardly.

The pile is first driven into the seafloor to a desired depth then any debris that is in the internal portion of the pile is washed out so that the spreader tool will have an unobstructed passage down the length of the pile. The spreader tool is then inserted down the length of the pile in conjunction with a spreader tool follower to force all the barbs out into the seafloor. Once this is done the lateral placement of the barbs should resist any uplifting caused by the positively buoyant tension leg platform.

BRIEF DESCRIPTION OF THE DRAWINGS

FIG. 5 shows the insertion of the spreader tool follower; and

FIG. 5*a* shows an enlarged view of a barb as extended.

FIG. 6 shows a completed pile installation.

DETAILED DESCRIPTION OF THE INVENTION

Figure 1:
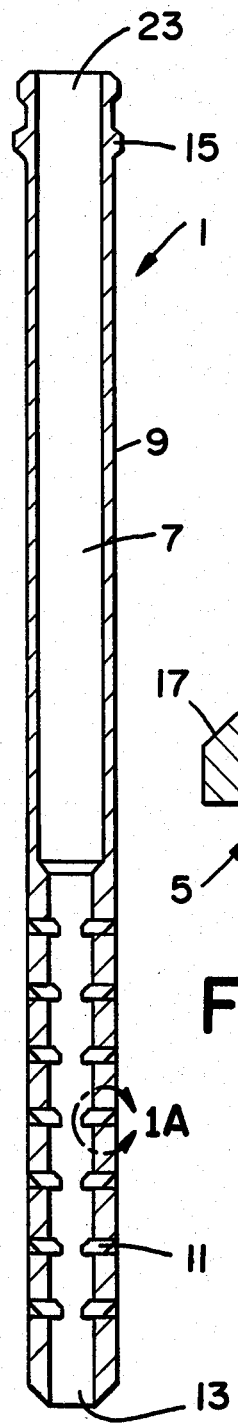
FIG. 1 shows a sectional view of the barbed pile.
Figure 1A:
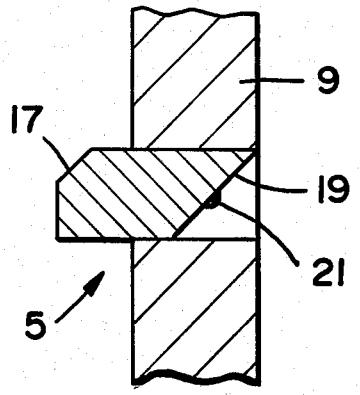
FIG. 1A shows an enlarged view of the barbed pile as recessed into the pile wall.

As shown is FIG. 1 the entire barbed pile 1 has a wall 9, a hollow inner space 7 that runs the length of the pile, an upper 15 and lower end 13, and barbs 11. The wall thickness increases in the area of the barbs 11 with a corresponding decrease in internal diameter. Pile 1 may opened or closed at the lower end 13 but the embodiment in the drawings shows the pile 1 as opened. It is not critical to choose whether the pile end 13 should be open or closed, the most important factor is that pile 1 can be driven to its predetermined depth, a depth chosen to be somewhat less than refusal depth. If the pile end 13 is closed, something along the lines of a conical end may facilitate ease of driving. The upper end 15 of pile 1 has an opening 23 to facilitate installation of the pile 1 and the barbs 11. Referring now to FIG. 1A an enlarged view of the barb 11 is shown in an unextended position 5 as it is recessed within the pile wall 9. Barb 11 has a generally rhomboid shape with an upwardly facing inner surface 17 and a downwardly facing outside surface 19. It may be placed substantially 90° to the axis of the pile and may radiate outwardly in any direction. Barb 11 may have a small tack-weld 21 to hold it in place while the pile 1 is being driven into the seafloor 33. In the unextended position 5, barbs 11 fit within wall 9 so that the inner surface 17 is completely exposed.

Figure 2:
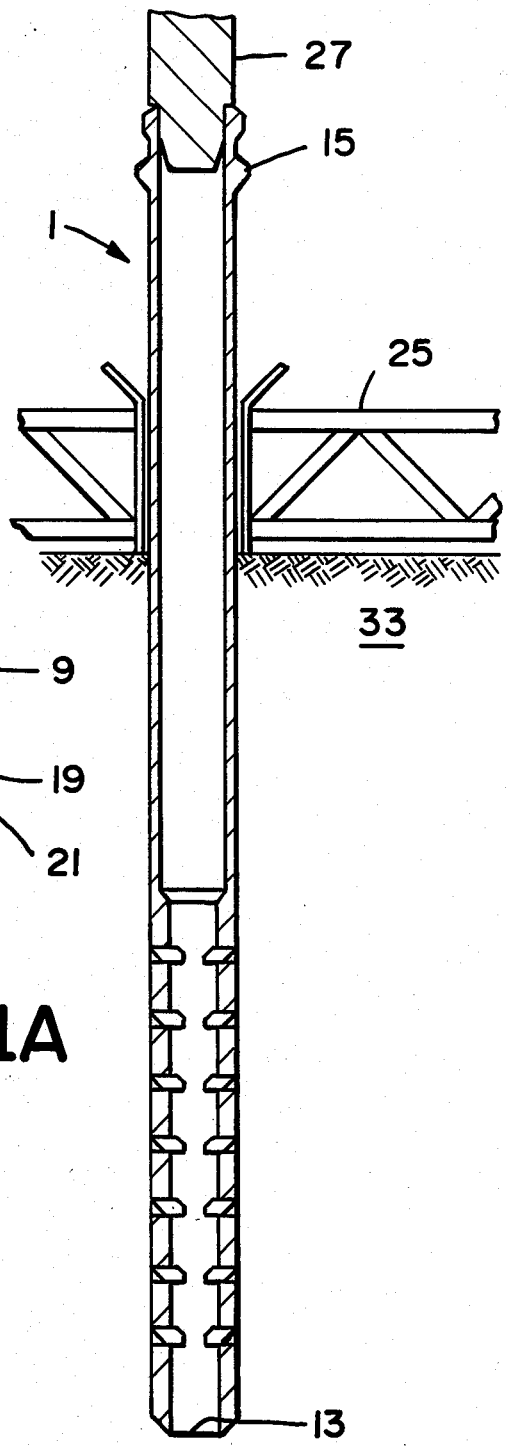
FIG. 2 shows a view of the pile as it is driven into the seafloor.

FIG. 2 shows the first step in installing pile 1. A pile template 25 is set on the seafloor 33 for accurate pile placement and a pile is inserted into one of the openings. A driving head 27 on an underwater hammer (not shown) is then placed against the upper part 15 of pile 1 and it is driven to a specific depth through the template 25 into the seafloor 33. As pile 1 is being driven downward the open end 13 admits soil into the hollow interior 7 of the pile 1. (Of course, this will not happen if the end 13 is closed.) There are other ways to set the pile to a predetermined depth. For example, an undersized hole may be predrilled to a desired depth and the pile may be inserted with the weight of a heavy follower. In some cases this method may be easier, less damaging to the pile, quicker, and may achieve the proper grade more accurately.

Figure 3:
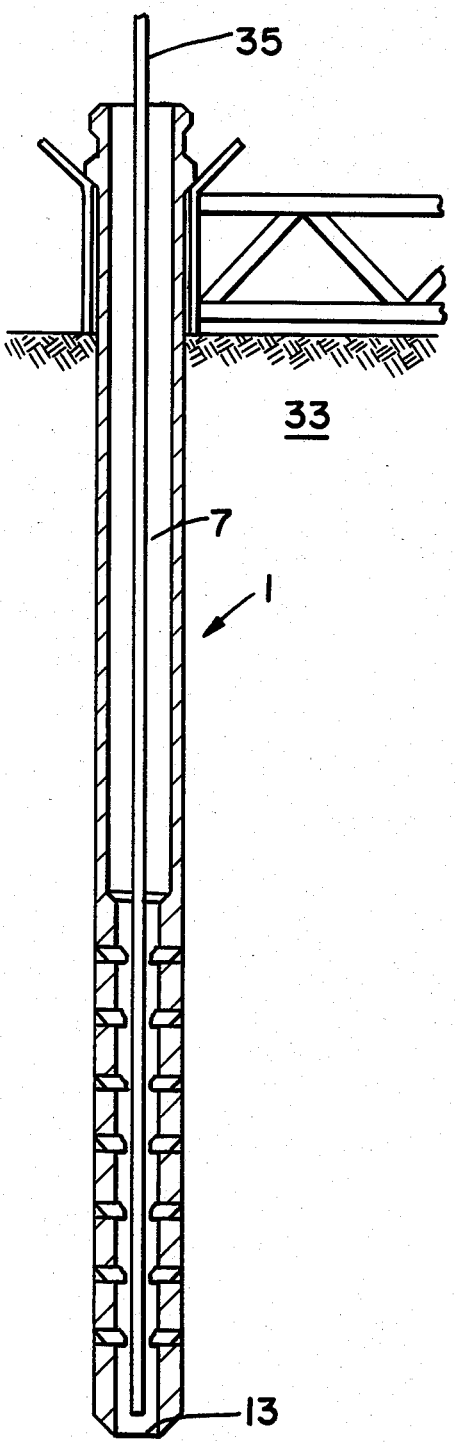
FIG. 3 shows the pile as it is being washed free of debris within the internal space.

FIG. 3 shows the insertion of a washline 35 into the interior 7 of the pile 1 to cleanup the sand and soil that is accumulated during the driving process. A variety of devices may be used to either blow or suction the debris, but all that is needed is something to remove the detritus from the interior 7 of pile 1.

Figure 4:
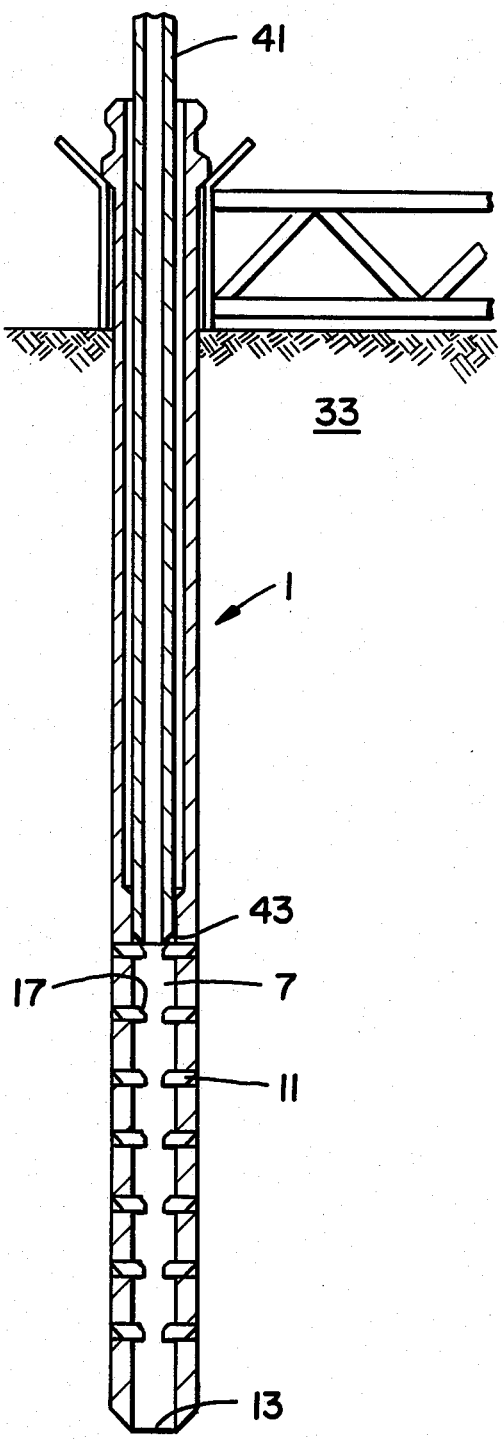
FIG. 4 shows the insertion of the spreader tool into the pile.

FIG. 4 shows the insertion of a spreader tool 41 into the interior 7 of pile 1 once this cleanup has been accomplished. Spreader tool 41 is used to push the barbs into the seafloor 33 and has an inward and downward sloping surface 43 to engage the upwardly facing inner edge 17 of barb 11. The contact between the front surface of the tool and the upper surface of the barb, plus the downward pressure of the tool forces barb 11 outwardly into the seafloor 33. Even though this tool may be fashioned in other ways to achieve the same affect, its main purpose is to provide a horizontal force to push the barbs 11 outward.

FIGS. 5 and 5*a* shows barbs 11 as they are projected outwardly into position 53. To ensure that spreader tool 41 has properly engaged all barbs 11 it is driven downward by a spreader tool follower 51 which is also driven by the underwater hammer 27. After tool 41 has been driven to its maximum depth, the follower 51 is retrieved. Once this is accomplished all barbs 11 are set in place and the pile 1 is complete. In the extended position 53, all barbs 11 are displaced into the seafloor 33, but not beyond a position where they are not supported by the pile wall 9. The barbs transmit the full uplift loads into the supporting pile wall 9 which, of course, increases the amount of force needed to pull up the pile 1 itself. Before, mere friction on the exterior of the pile surface was the only factor in resisting the uplift forces, so that resistance was a function of depth. Now however, that variable has been eliminated as pile security is no longer dependent on the depth to which it is buried. Each anchor pile 1 may be driven into the seafloor 33 to what now may seem to be a minimal depth. Unless the depth of refusal is less than the desired pile depth, the pile 1 may be set and resistance to uplift loads should be equal to all other piles.

Since many modifications and variations of the present invention are possible within the spirit of this disclosure, it is intended that the embodiments disclosed are only illustrative and not restrictive. For that reason, reference is made to the following claims rather than to the specific description to indicate the scope of this invention.

What is claimed is:

1. An anchor for an offshore platform comprising:

an anchor pile having a central axis along its length;

a plurality of movable barbs, each barb having a central axis along its length, said barbs located along the length of the pile, the axis of each movable barb being approximately 90° to the central axis of the pile, said barbs generally shaped like a rhombus having an inner surface and an outer surface, said inner surface facing upward and said outer surface facing downward; and a spreader tool having a downward and inward sloping lower edge to engage the barbs so that when the tool is driven downward the barbs are forced outward by the contact between the downward and inward sloping lower edge and the barbs' upward facing inner surface.

2. The anchor as recited in claim 1 where the internal diameter of the pile decreases and the external diameter remains the same in the area that the barbs are located so that more structural support may be given to the barbs.

3. The anchor as recited in claim 1 where the barbs are tack-welded onto the pile so that said barbs may be held in place while driving the pile into the seafloor.

4. An anchor for an offshore platform comprising:

a hollow pile with a decrease in internal diameter part of the way down the pile length, said pile having a central axis along its length;

50 to 100 essentially rhomboid barbs with a central axis along the length of each of said barbs having an upwardly sloping inner surface and a downwardly sloping outer surfaces, each barb being closely spaced within a portion of the pile that has a greater wall thickness, the barbs being positioned with approximately 90° between the central axis of each of the barbs and the central axis of the pile so that in an unextended position said upwardly sloping inner surfaces are completely exposed to the interior of the shaft; and a spreader tool with a downwardly sloping frustoconical end and an external diameter small enough to fit within the smallest internal diameter of the hollow pile so that when the end of the spreader tool is inserted into and pushed vertically down the hollow pile said end will come in contact with the upwardly sloping inner surface of the barbs and force them horizontally straight out into a surrounding floor of a body of water.

* * * * *